US005697486A

United States Patent [19]

Krampl

[11] Patent Number: 5,697,486

[45] Date of Patent: Dec. 16, 1997

[54] DEVICE FOR THE GUIDANCE OF AN ENDLESS BELT FOR ESCALATORS OR MOVING WALKWAYS

[75] Inventor: David Krampl, Vienna, Austria

[73] Assignee: Investio AG, Hergiswil, Switzerland

[21] Appl. No.: 554,593

[22] Filed: Oct. 6, 1995

[30] Foreign Application Priority Data

Nov. 14, 1994 [CH] Switzerland ..... 03 399/94

[51] Int. Cl.[6] ..... B66B 23/12

[52] U.S. Cl. ..... 198/332

[58] Field of Search ..... 198/330, 332

[56] References Cited

U.S. PATENT DOCUMENTS

| | | | |
|---|---|---|---|
| 2,060,491 | 11/1936 | Dunlop | 198/332 |
| 2,103,327 | 12/1937 | Handy | 198/332 |
| 2,111,433 | 3/1938 | Margles et al. | 198/332 |
| 2,128,310 | 8/1938 | Margles . | |
| 2,570,135 | 10/1951 | Loughridge | 198/332 |
| 2,663,400 | 12/1953 | Margles et al. | 198/332 |
| 2,686,585 | 8/1954 | Margles et al. | 198/332 |
| 4,082,173 | 4/1978 | Simon-Kochloffel . | |

FOREIGN PATENT DOCUMENTS

| | | | |
|---|---|---|---|
| 0141519 | 5/1985 | European Pat. Off. . | |
| 1009777 | 6/1957 | Germany . | |
| 1809976 | 6/1970 | Germany | 198/332 |
| 706936 | 4/1954 | United Kingdom . | |

*Primary Examiner*—D. Glenn Dayoan
*Attorney, Agent, or Firm*—Greenblum & Bernstein, P.L.C.

[57] ABSTRACT

A device for the guidance of an endless belt for escalators or moving walkways in an endless belt of an escalator or a moving walkway, the chain rollers are guided by way of a support rail having a running track and by way of a compensating rail having a running track, and at the entry of a chain wheel, which deflects the endless belt, the chain rollers move from the rectilinear running track of the support rail onto the curved running track of the compensating rail and move from the compensating rail, at a tangent point, into engagement with the chain wheel, with the chain rollers being displaced, towards the chain wheel, by a spacing ($h_o$), during the movement thereof, from the running track of the support rail to the tangent point, with the spacing being measured transversely to the running direction, in the direction extending at right angles to the running direction, with this displacement having an advantageous effect on the quietness of operation of the endless belt.

6 Claims, 2 Drawing Sheets

DEVICE FOR THE GUIDANCE OF AN ENDLESS BELT FOR ESCALATORS OR MOVING WALKWAYS

CROSS REFERENCE TO RELATED APPLICATIONS

This application claims the priority of Swiss Application No. CH 03 399/94-8, filed Nov. 14, 1994, the disclosure of which is incorporated herein by reference in its entirety.

BACKGROUND OF THE INVENTION

1. Field of the Invention

The invention pertains to a device for the guidance of an endless belt for escalators or moving walkways comprising steps or pallets, of chain links which are connected with adjacent chain links by means of link pins and of chain rollers which are retained by the link pins, wherein the chain rollers are moved on a running track of a support rail and on a running track of a compensating rail and are deflected by a chain wheel.

2. Discussion of the Background of the Invention and Material Information

An escalator with a stair belt carrying steps and chain wheels is set forth in German Patent Publication DE 1 009 777. The chain wheels, each arranged at a respective end of the escalator, serve for the deflection and the drive of the stair belt. The stair belt consists of rollers which are connected by means of chain links and are guided on support rails. During the deflection of the stair belt at the escalator end, the rollers are carried by the chain wheel from the entry to the exit. The support rails are so arranged that the rollers on the chain wheel execute a rotation of 180°. The travel from the vertical center line of the chain wheel to the support rail is bridged over by a tangential guide arranged laterally at the chain wheel. At the entry, the tangential guide takes over the rollers from the support rail and guides the rollers in a tangential direction to the chain wheel pitch circle. At the exit, the rollers leave the chain pitch circle after a rotation of 180°, in a tangential direction, and are guided onwards form there to the support rail by the tangential guide.

The tangential guides do not eliminate the jerky movements and noises of the chain links which occur upon the engagement of the rollers with the teeth of the chain wheel and on the detachment of the rollers from the chain wheel. The jerky movements lead, in the resonance range, to longitudinal and transverse oscillations which are perceived as unpleasant by the passenger and which lead to a qualitative loss due to excessive wear of the mechanical parts.

Thus, it is the task or object of this invention to provide a remedy for the previously noted problems.

SUMMARY OF THE INVENTION

The invention, as set forth in the appended claims solves the noted problems by avoiding the disadvantages of the known device by so constructing the guidance of the endless belt that the travel comfort perceived by the passenger is great, that jerky movements and noises are avoided, and that the mechanical wear is kept at a low level.

Specifically, one embodiment of the present invention pertains to a device for the guidance of an endless belt for at least one of escalators and moving walkways comprising one of steps and pallets, of chain links, with the chain links being connected with adjacent chain links by means of link pins and chain rollers, with the chain rollers being retained by the link pins, with the chain rollers being moved on a running track of a support rail and on a running track of a compensating rail and being deflected by a chain wheel, wherein the running track of the support rail and the running track of the compensating rail are arranged at a chain pitch circle of the chain wheel externally of a tangent extending in the running direction of the endless belt, and wherein the running track of the compensating rail is guided, at one end, towards the chain wheel pitch circle.

In a further embodiment of the device of this invention, the running track of the support rail is arranged parallel to the tangent and at a spacing ($h_0$) from the tangent and wherein the running track of the compensating rail has a curved shape at one end, with the chain rollers changing from a rectilinear movement into a curved movement and changing into a circular movement at a tangent point.

In another embodiment of the device of this invention, the shape of the curve of the running track of the compensating rail and the spacing ($h_0$) are calculated from the number of the chain wheel teeth, the link pin spacing (l) and from the radius (r) of the chain wheel pitch circle by means of the set of equations $$h_0+r=1*\sin\epsilon_1+l\cdot\sin\epsilon_2+r*\cos\Phi$$

$$x_2=1*\cos\epsilon_1+1\cdot\cos\epsilon_2-r*\sin\Phi$$

$$y=1*\sin\epsilon_1$$

$$\dot{x}_2=-f*\Phi*r$$

wherein the variables $\epsilon_1$ and $\epsilon_2$ signify the instantaneous angle of a chain link relative to the tangent to the chain pitch circle, wherein variable $\Phi$ signifies the instantaneous angle between the tangent point and a link pin at the chain wheel pitch circle, wherein f signifies a speed factor and the variables $x_2$ and y signify the instantaneous travel of a link pin respectively, in the direction of the tangent and at right angles to the direction of the tangent.

Quiet running properties act favorably on the service life of the mechanical parts and cause fewer repair and maintenance operations. It is furthermore advantageous that smaller chain wheel diameters and/or longer chain links are possible. Increased quietness of operation assures the passenger a fatigue-free stay on the transport apparatus. Moreover, by reason of the shock-free, jerk-free and vibration-free stay on the escalator or the moving walkway, the passenger draws positive conclusions about the mechanical quality of the transport apparatus.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figures 1, 2, 3, 4:
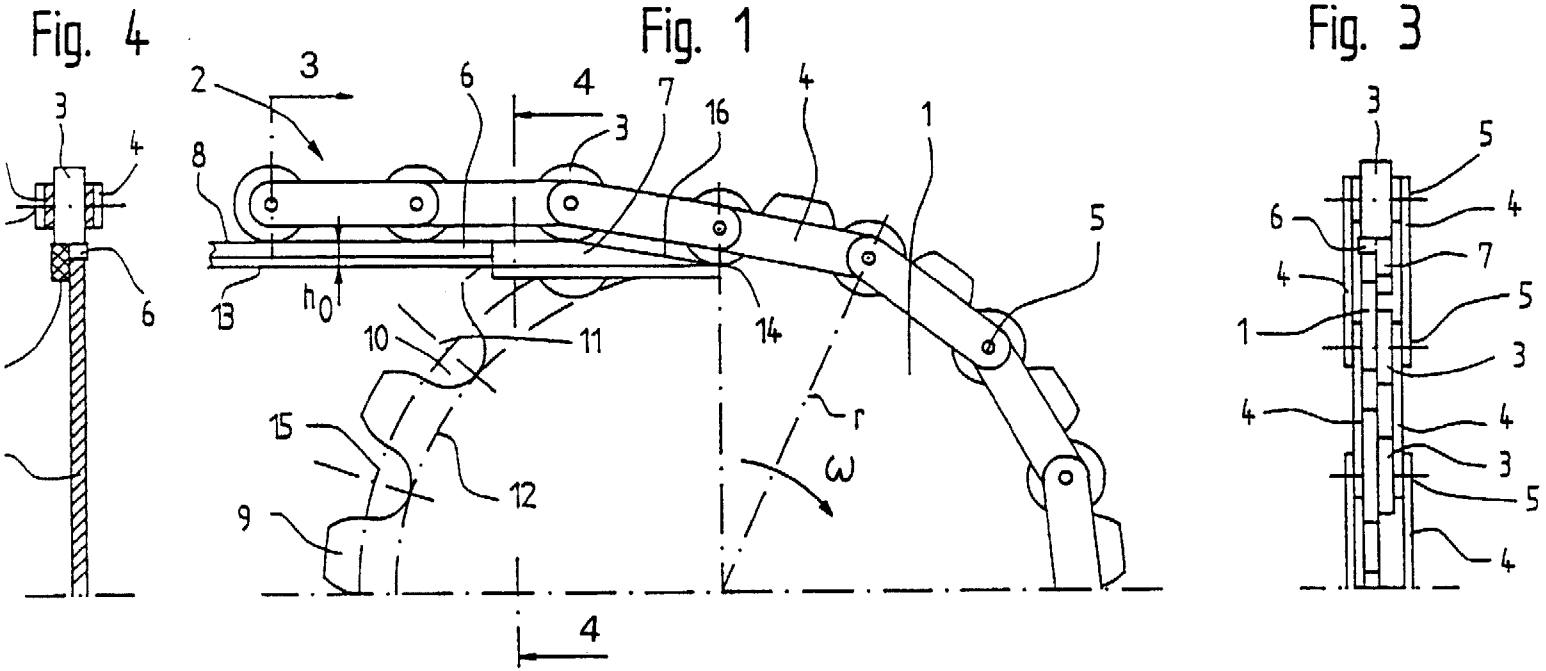
FIG. 1 is a schematic illustration of chain wheel with an endless belt of an escalator or a moving walkway.
FIG. 2 is a top plan view of the chain wheel and the belt of FIG. 1.
FIG. 3 is a side elevational view of the chain wheel and of the belt of FIG. 1.
FIG. 4 is a sectional view taken along line 4—4 of FIG. 1.

A chain wheel, which serves for the deflection and the drive of an endless belt 2 of an escalator or a moving walkway, is denoted by numeral 1 in FIGS. 1 to 7. FIG. 1 shows the entry of endless belt 2 onto chain wheel 1. The running-off or exit of endless belt 2 which is in mirror image or allochiral to the entry thereof is not illustrated. Endless belt 2 consists of non illustrated steps or pallets and of chain rollers 3, which are connected by means of chain links 4 and link pins or bolts 5. Chain rollers 3 run on a support rail 6 and a compensating rail 7 arranged laterally at chain wheel 1. Chain wheel teeth 9, arranged at the circumference of chain wheel 1, form tooth gaps 10, into or with which chain rollers 3 engage. The axis of a tooth gap 10 is denoted by numeral 11 and is at right angles to a chain wheel pitch circle denoted by numeral 12. A tangent 13, which extends in parallel to a running track 8 of support rail 6, at chain wheel pitch circle 12, extends at right angles to the respective tooth gap axis 11 at tangent point 14. At tangent point 14, chain roller 3 enters into engagement with chain wheel 1 at the entry side or leaves chain wheel 1 at the exit side and then enters onto compensating rail 7 arranged at the exit side. Link pins 5 move on chain wheel 1 at an angular speed or velocity w on a wheel pitch circle 15 having a radius r and on running track 8 of support rail 6 at a speed v. The rectilinearly extending running track 8 of support rail 6 merges into a curved running track 16 of compensating rail 7, which ends at tangent point 14. Running track 8 of support rail 6 lies at a certain spacing $h_o$ externally of tangent 13 so that chain rollers 3 move in a forward direction and at right angles to the forward direction on running track 16 of compensating rail 7.

Figure 6:
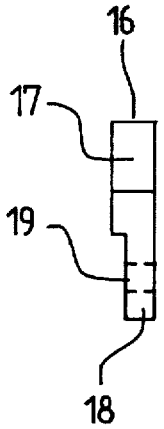
FIG. 6 is an end view of the compensating rail of FIG. 5.
Figure 5:
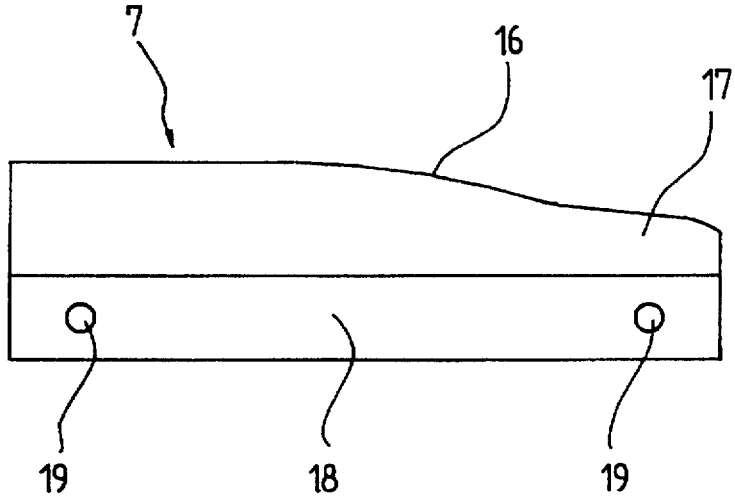
FIG. 5 is a partial side elevational view of a compensating rail.

FIGS. 5 and 6 show details of compensating rail 7 which consists of a rail body 17 having a running track 16 and a rail foot 18, the latter having bores 19 therein. Compensating rail 7 is fastened to the frame of chain wheel 1 by means of screws passing through bores 19.

Figure 7:
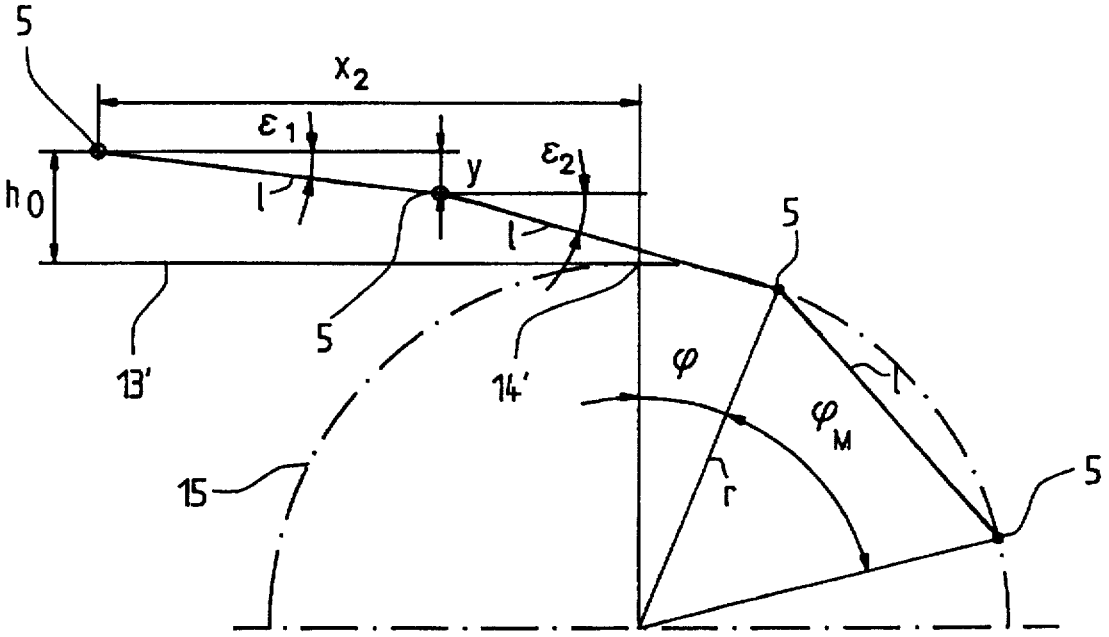
FIG. 7 is a schematic illustration of the chain wheel and of the belt for use in formulating the mathematical statement for the derivation of an optimum running path of the compensating rail.

FIG. 7 schematically shows the chain wheel and the belt or band for formulating the mathematical statement for the derivation of an optimum shape of the curve of running track 16 of compensating rail 7. The pitch of endless belt 2 is represented by the variable 1. Variable 1 is the spacing between two neighboring link pins 5. The instantaneous angle between tangent point 14' and link pin 5 at wheel pitch circle 15 is illustrated by $\Phi$. Two neighboring link pins 5 located on chain wheel pitch circle 15 form an angle $\Phi_m$ at the center of chain wheel 1. The variables $\epsilon_1$ and $\epsilon_2$ represent the instantaneous angle of chain wheel 4 relative to tangent 13' at chain wheel pitch circle 15. The variables $x_2$ and y describe the instantaneous travel, respectively, in the tangent direction and at right angles to the tangent direction. The optimum shape of the curve of running track 16 of compensating rail 7 is calculated according to the following set of equations:

$$h_0+r=1*\sin\epsilon_1+l\cdot\sin\epsilon_2+r*\cos\Phi \quad [1]$$

$$x_2=1*\cos\epsilon_1+1\cdot\cos\epsilon_2-r*\sin\Phi \quad [2]$$

$$y=1*\sin\epsilon_1 \quad [3]$$

$$\dot{x}_2=-f*\Phi*r \quad [4]$$

By solving the differential equation [4], there results the equation $$\int\dot{x}_2=-\int f*\Phi*r \quad x_2=-f*\Phi*r+C \quad [4']$$

By reason of the cyclical movement, the initial integration constant $\Phi=0$ and the final integration constant $\Phi=2\pi/z$ apply, with z being the number of teeth of chain wheel 1. The speed factor f can be determined by equation [4'] and the initial and final integration constants. For an optimum course of the curve, the rotational speed $\omega$ and the translational speed v must be coupled by speed factor f, which, for example for a chain wheel 1 with 16 chain wheel teeth has a value of 0.993587.

From the equations [1], [2] and [4'], $\sin\epsilon_1$ of equation [3], and thus from y the optimum curve shape of running track 16, can be determined. For a certain number of chain wheel teeth, for a certain link pin spacing 1, and for a certain radius r of chain wheel pitch circle 15, there is exactly one speed factor f, exactly one spacing $h_0$ and only one optimum shape of the curve of running track 16.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A device for the guidance of an endless belt for at least one of escalators and moving walkways comprising one of steps and pallets, of chain links, with the chain links being connected with adjacent chain links by link pins and chain rollers, with the chain rollers being retained by the link pins, with the chain rollers being moved on a running track of a support rail and on a running track of a compensation rail and being deflected by a chain wheel, wherein a the running track of the support rail and the running track of the compensation rail are arranged externally of a tangent to a chain pitch circle of the chain wheel that extends in the running direction of the endless belt, and wherein the running track of the compensating rail is guided, at one end, towards a chain wheel pitch circle.

2. The device of claim 1, wherein the running track of the support rail is arranged parallel to the tangent and at a spacing ($h_0$) from the tangent and wherein the running track of the compensating rail has a curved shape at one end, with the chain rollers changing from a rectilinear movement into a curved movement and changing into a circular movement at a tangent point.

3. The device of claim 2, wherein the shape of the curve of the running track of the compensating rail and the spacing ($h_0$) are calculated from the number of the chain wheel teeth, the link pin spacing (1) and from the radius (r) of the chain wheel pitch circle by means of the set of equations $$h_0+r=1*\sin\epsilon_1+l\cdot\sin\epsilon_2+r*\cos\Phi$$

$$x_2=1*\cos\epsilon_1+1\cdot\cos\epsilon_2-r*\sin\Phi$$

$$y=1*\sin\epsilon_1$$

$$\dot{x}_2=-f*\Phi*r$$

wherein the variables $\epsilon_1$ and $\epsilon_2$ signify the instantaneous angle of a chain link relative to the tangent to the chain pitch circle, wherein variable $\Phi$ signifies the instantaneous angle between the tangent point and a link pin at the chain wheel pitch circle, wherein f signifies a speed factor and the variables $x_2$ and y signify the instantaneous travel of a link pin respectively, in the direction of the tangent and at right angles to the direction of the tangent.

4. A device for the guidance of an endless belt for at least one of escalators and moving walkways, the endless belt including a plurality of one of steps and pallets, said device comprising:

a plurality of link pins and chain rollers for coupling a plurality of chain links;

said chain rollers traversing a running track of a support rail and a running track of a compensating rail and a chain wheel, defining a chain pitch circle, deflecting said chain rollers in path defined by the chain pitch circle;

said running track of the compensation rail comprising a profiled surface facilitating engagement of said chain rollers with said chain wheel;

said chain rollers engaging said chain wheel at a point tangent to said chain pitch circle that extends in the running direction of the endless belt;

said profiled surface comprising first and second end, said first end coupled to said running track of said support rail and said second end comprising a curved shape; and said first end positioned outside of said tangent point at a distance $h_0$.

5. The device of claim 4, said profiled surface comprising a shape determined from said distance, a number chain wheel teeth, link pin spacing (l), and a radius (r) of a chain wheel pitch.

6. The device of claim 5, said shape determined by the following equations:

$$h_0+r=l*\text{sine}\ \epsilon_1+l*\sin\epsilon_2+r*\cos\Phi;$$

$$x_2=l*\cos\epsilon_1+l*\cos\epsilon_2-r*\sin\Phi;$$

$$y=l*\sin\epsilon_1;\ \text{and}$$

$$\dot{x}_2=-f*\Phi*r;$$

where $\epsilon_1$ and $\epsilon_2$ represent an instantaneous angle of a chain link relative to a tangent line through said tangent point, $\Phi$ represents an instantaneous angle between said tangent point and a link pin at said chain wheel pitch, f represents a speed factor, and $x_2$ and y represent the instantaneous travel of a link pin in a direction parallel and perpendicular to said tangent line.

* * * * *